United States Patent [19]

Swainbank et al.

[11] Patent Number: 4,788,992

[45] Date of Patent: Dec. 6, 1988

[54] ULTRASONIC STRIP CLEANING APPARATUS

[75] Inventors: Hugh B. Swainbank; Christopher A. Swainbank, both of Woodbury; Kenneth R. Allen, Jr., Roxbury, all of Conn.

[73] Assignee: Lewis Corporation, Oxford, Conn.

[21] Appl. No.: 43,434

[22] Filed: Apr. 28, 1987

[51] Int. Cl.[4] ..... B08B 3/02; B08B 3/04

[52] U.S. Cl. ..... 134/64 R; 134/1; 134/108; 134/111; 134/122 R; 134/184

[58] Field of Search ..... 134/1, 64 R, 64 P, 184, 134/107–109, 111, 122 R, 122 P

[56] References Cited

U.S. PATENT DOCUMENTS

| | | | |
|---|---|---|---|
| 3,023,686 | 3/1962 | Meyer | 134/64 R |
| 3,371,233 | 2/1968 | Cook | 134/184 |
| 3,433,462 | 3/1969 | Cook | 366/127 |
| 3,572,352 | 4/1971 | Koopman | 134/122 R |
| 3,582,400 | 6/1971 | Miller | 134/122 R X |
| 3,596,883 | 8/1971 | Brech | 366/127 X |
| 3,600,223 | 8/1971 | Glick et al. | 134/1 |
| 3,610,260 | 10/1971 | Kearney | 134/109 X |
| 3,724,418 | 4/1973 | McLain | 134/108 X |
| 3,871,982 | 3/1975 | Idstein | 134/64 R X |
| 4,046,592 | 9/1977 | Westervelt et al. | 134/1 |
| 4,071,225 | 1/1978 | Holl | 366/127 X |
| 4,167,424 | 9/1979 | Jubenville et al. | 134/184 X |
| 4,170,241 | 10/1979 | Clapp | 134/184 X |
| 4,244,078 | 1/1981 | Hughes et al. | 134/64 P X |
| 4,311,157 | 1/1982 | Jubenville et al. | 134/184 X |
| 4,391,672 | 7/1983 | Lehtinen | 134/1 X |
| 4,475,259 | 10/1984 | Ishii et al. | 134/184 X |
| 4,515,456 | 5/1985 | Ferrante | 366/127 X |
| 4,521,092 | 6/1985 | Ferrante | 366/127 X |
| 4,556,467 | 12/1985 | Kuhn et al. | 134/1 X |
| 4,589,926 | 5/1986 | Holmstrand | 134/109 X |
| 4,605,027 | 8/1986 | Dallot | 134/184 X |

OTHER PUBLICATIONS (Dec. 1977) Lewis RUM Reverberatory Ultrasonic Mixer Literature.

*Primary Examiner*—Harvey C. Hornsby
*Assistant Examiner*—Stephen F. Gerrity
*Attorney, Agent, or Firm*—Mattern, Ware, Stoltz & Fressola

[57] ABSTRACT

Apparatus for continuous ultrasonic cleaning all exposed surfaces of endwise advancing strip material employ an elongated ultrasonic cleaning chamber with entry and exit portals formed near the lower edges of its end walls through which the strip travels into, through and out of the cleaning chamber. Cleaning liquid flows continuously from the cleaning chamber through both portals and an overflow conduit into collection chambers from which it is drained, filtered, cooled and recirculated into the ultrasonic cleaning chamber at a high volumetric flow rate. Two parallel elongated ultrasonic plate diaphragms energized at substantially different ultrasonic frequencies flank the advancing strip immersed well below the free surface of liquid in the cleaning chamber, and sonic waves travel rapidly along the strip, cooperating with nearfield vibratory effects near the plate-liquid interface of both plates to achieve intense and highly efficient cleaning of the strip. This is preferably followed by air knife flow drying, rinsing, additional air knife drying, and by final drying of any remaining moisture if desired.

20 Claims, 7 Drawing Sheets

GENERATOR/ CONTROL ENCLOSURE (4) GENERATOR, TRANSFORMER, 480 V. CONTROLS
CABINET COOLER
ULTRASONIC NEARFIELD UNIT
AIR INTAKE FILTER/ SILENCER
SPRAY CHAMBER
AIR KNIFE CHAMBER
DEWATERING
STRIP
20 KHz TRANSDUCERS
16 KHz TRANSDUCERS
DEWATERING CHAMBER
SPRAY CHAMBER
AIR KNIFE CHAMBER
EXHAUST BLOWER
WASH SOLUTION TANK (200 GAL.)
SPRAY RESER-VOIR (62 GAL.)
COOLING COIL

ULTRASONIC STRIP CLEANING APPARATUS

This invention relates to improved methods and apparatus for ultrasonic cleaning of elongated strip material, and particularly to techniques by which relatively rigid rods, tubes, strips or moldings of metal, glass or plastic travel horizontally through a cleaning bath between two submerged plates vibrated at different ultrasonic frequencies.

Conventional pressure spray washing equipment is bulky, heavy and expensive, requiring large areas of floor space in manufacturing plants, consuming large volumes of washing liquids and excessive amounts of electrical energy, and achieving less than satisfactory cleaning results. Residues of forming lubricants, mold release agents, grease, oil or abrasive powders such as rouge, crocus or other fine particulate matter often remain, even after the attempted spray washing has been completed. Concave grooves and undercut flanges of rolled or extruded moldings are difficult to clean effectively by any conventional washing techniques.

Prior ultrasonic cleaning devices for elongated strip or sheet or web material such as magnetic tape or photographic film have normally led the material along a curved catenary-shaped path downward into the cleaning bath and then upward out of the bath, as in U.S. Pat. Nos. 4,605,027, 4,521,092, 4,311,157, 3,572,352, and 4,167,424.

Prior proposals for ultrasonic treatment of elongated material traveling along a straight submerged path have involved flexible material curved around guide rollers in U.S. Pat. Nos. 4,046,592, 4,391,672 and 3,582,400, or individual separate pieces like the photographic plates treated in U.S. Pat. No. 4,515,456.

Simultaneous ultrasonic treatment employing different frequencies is discussed in U.S. Pat. Nos. 3,433,462, 3,596,883, 4,391,672, 4,071,225 and 3,371,233.

The ultrasonic treatment of continuous elongated relatively rigid strip material in high volume production line operations is believed to be unique, and the techniques of this invention are not believed to have been suggested by prior commercial developments, patents or publications.

In the methods and apparatus of this invention, the strip material travels horizontally through a counter-flowing liquid chamber containing mild emulsifying soap solution or similar mild solvent, passing between two submerged plates vibrated ultrasonically at different frequencies.

The strip material is not bent or forced to sag, but is maintained straight throughout the cleaning operation, utilizing externally applied tension in cases of non-rigid strip. It enters the ultrasonic bath through an emerging stream of liquid flowing out through an entrance portal, and after cleaning the strip, leaves the bath through an emerging stream of liquid flowing out through a similar exit portal.

These portal streams of liquid are collected, filtered, cooled and recirculated by a circulation pump, and the configuration of the cleaning bath chamber assures the complete immersion of the vibrated plates and the strip traveling between them, substantially eliminating entrapped air bubbles.

Following the ultrasonic cleaning, the strip material passes through compressed air knives or dewatering blowers and clean water rinsing sprays, and a final drying stage of strip heating can be employed to complete the cleaning treatment.

The methods and apparatus of this invention are economical, compact and highly effective. Strip material cleaned by the techniques of this invention, and then tested with drops of test liquid of progressively higher surface tension, have been reported to be the cleanest ever observed in customers' production runs. Their freedom from residues of oil and grease was the highest ever seen. Metallic strip materials treated by the techniques of this invention can be pressure welded by resistance welding without requiring the addition of flux, and this provides another proof of highly effective cleaning.

The efficiency and compactness of the strip cleaning apparatus of this invention permits the use of minimum floor space, and these units consume reduced volumes of liquids, and require much less electrical power than conventional pressure-spray washing enclosures.

Accordingly, a principal object of this invention is to provide techniques, methods and apparatus for efficient ultrasonic cleaning of unbent elongated strip material by delivering the strip through an overflowing, recirculating ultrasonic cleaning bath exposed to two different ultrasonic vibratory frequencies.

Another object of the invention is to provide such cleaning techniques utilizing a counter-flowing recirculating cleaning bath having liquid-releasing end portals through which the unbent elongated strip material enters and leaves the cleaning bath.

A further object of the invention is to provide such cleaning techniques utilizing a cleaning bath chamber producing counter-current liquid flow with continuous liquid overflow, filtering and recirculation.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

Figure 1:
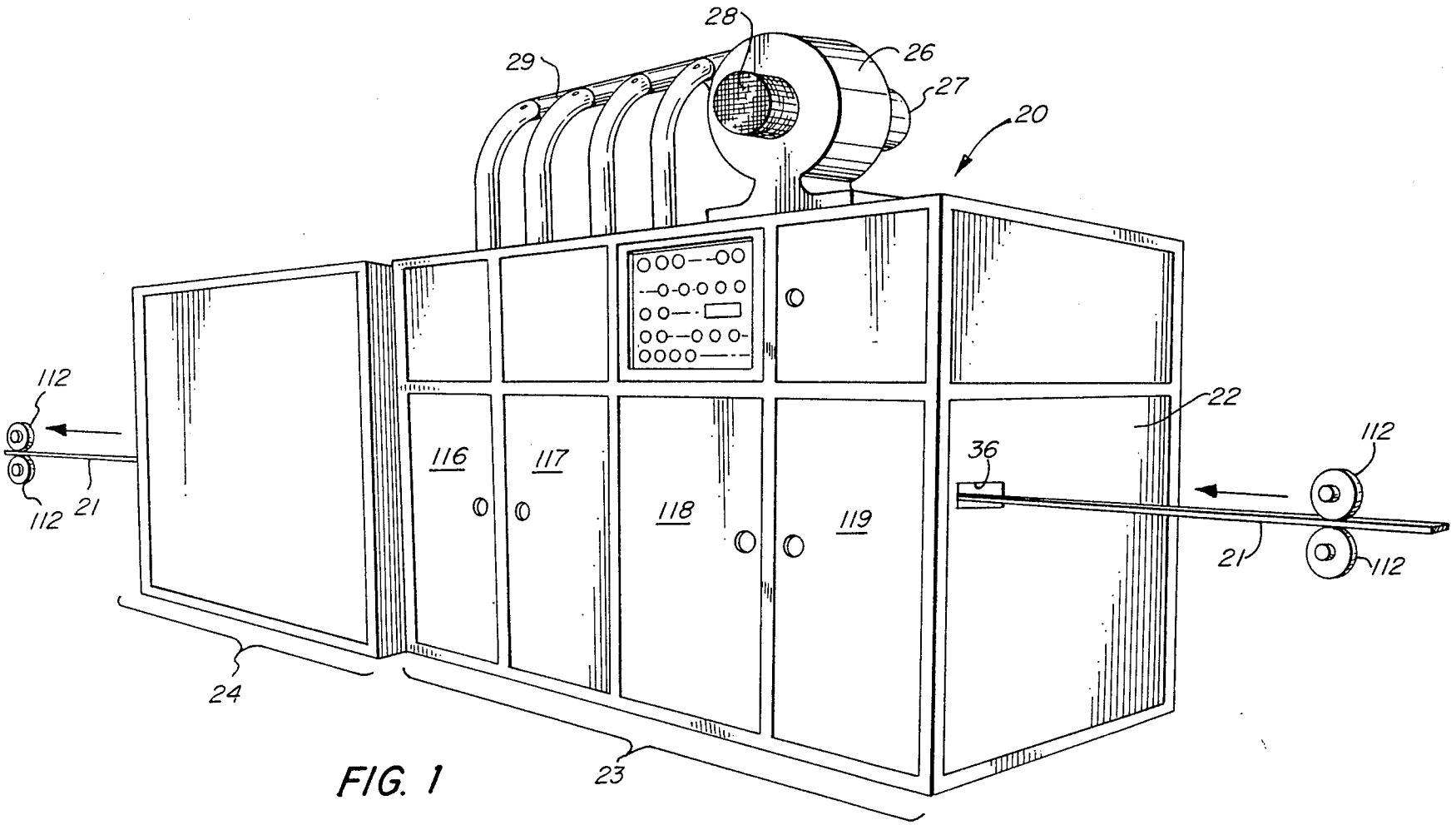
FIG. 1 is a perspective view of an ultrasonic strip cleaning unit employing the methods and apparatus of the present invention.

A preferred form of the apparatus employing the methods of the invention for ultrasonic cleaning of continuous elongated strip material, such as extruded metal or plastic automotive trim strips, is shown in the drawings.

In the ultrasonic treatment unit 20 shown in FIG. 1, the elongated strip 21 enters the housing 22 of the cleaning unit 23 where cleaning, rinsing and drying steps are continuously performed.

Beyond cleaning unit 23, an infrared heater 24 receives the advancing clean strip, and the clean, heat-dried strip is shown emerging from heater 24 at the left side of FIG. 1. Throughput strip velocities on the order of 100 feet per minute or more are easily attained with this equipment while achieving and maintaining unexpectedly high quality cleaning performance.

Figures 2, 3, 4:
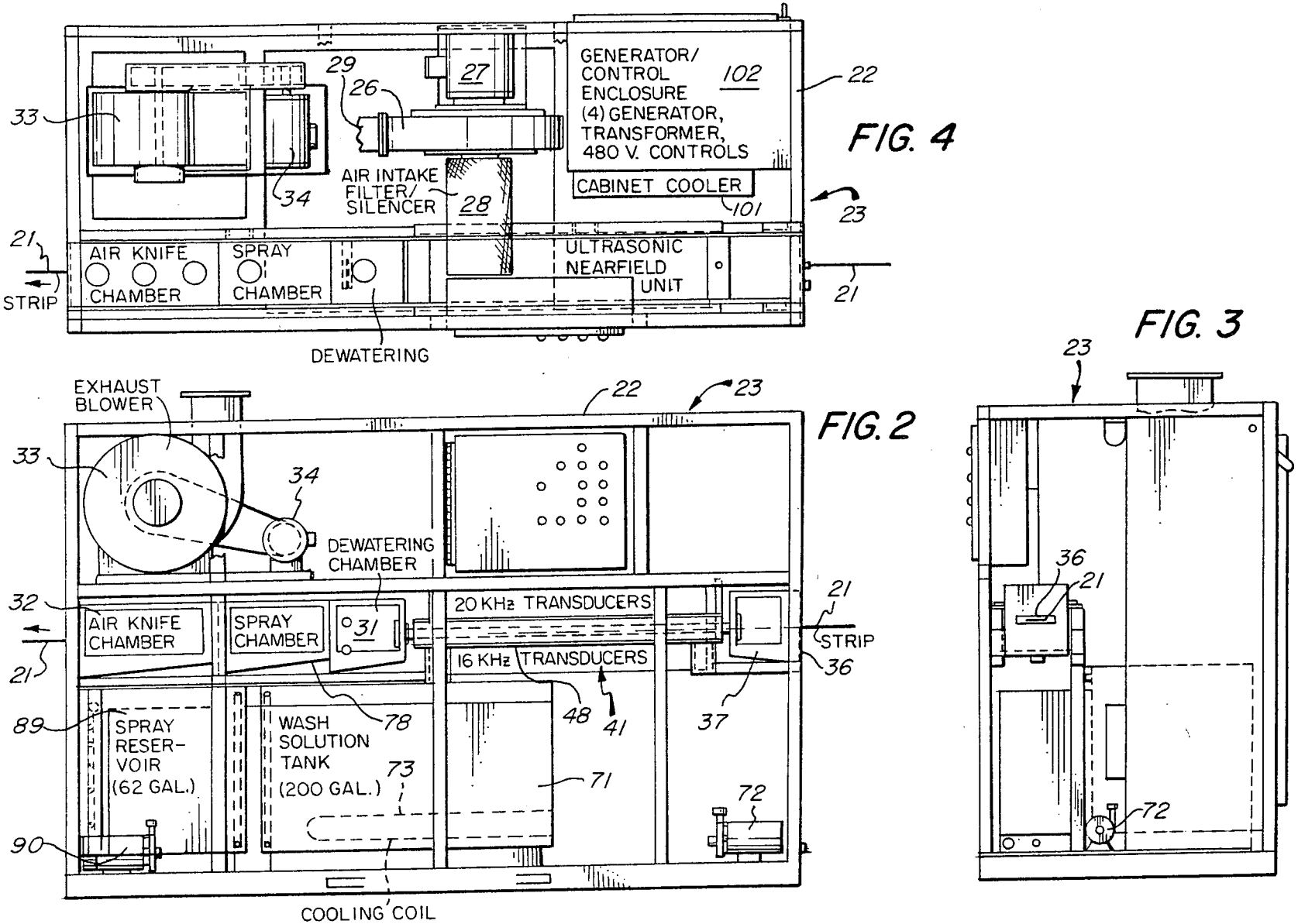
FIGS. 2, 3 and 4 are respective front, end and top schematic views of the ultrasonic cleaning, rinsing and air drying portions of the unit of FIG. 1.

The front, end and top views of FIGS. 2, 3 and 4 show the principal subassemblies combined in cleaning unit 23. As shown in FIG. 1, housing 22 is surmounted by a pressure blower 26 driven by a 5 HP electric motor 27, drawing intake air through a filter-silencer 28 and delivering pressurized air through conduits 29 to air knife dewatering chambers 31 and 32 inside housing 22.

An exhaust blower 33 mounted with its drive motor 34 inside housing 22 draws air from both air knife dewatering chambers 31 and 32, from spray rinse chamber 78–83, and from heater housing 24, exhausing heat and humidity from these portions of the equipment, and maintaining the air stream flowing through the dewatering stages of the treatment.

Figure 5:
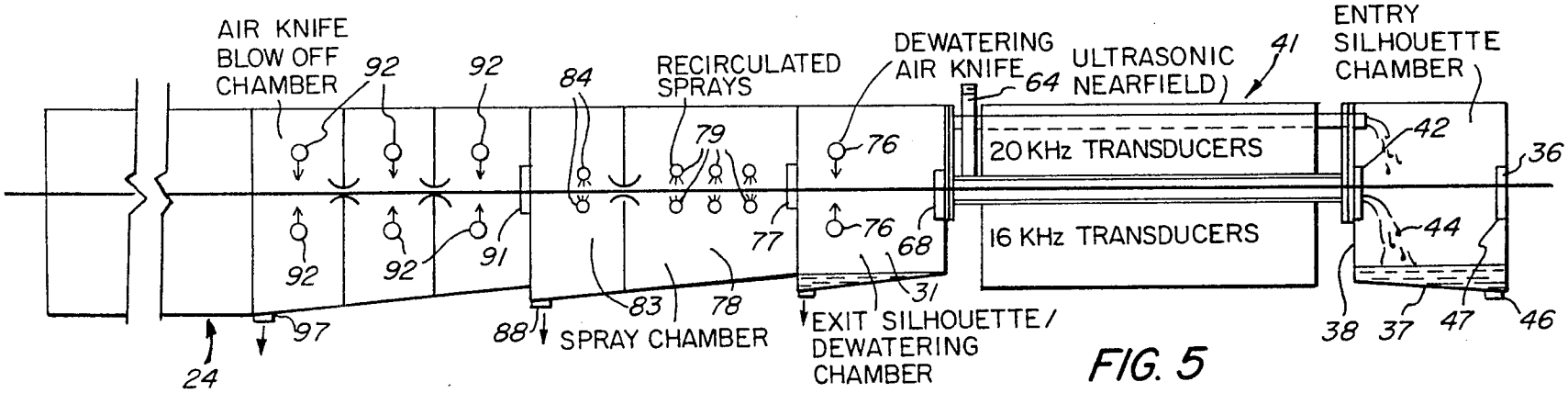
FIG. 5 is a schematic side elevation view of the strip treatment chambers through which the strip passes successively in the apparatus of the invention.
Figure 6:
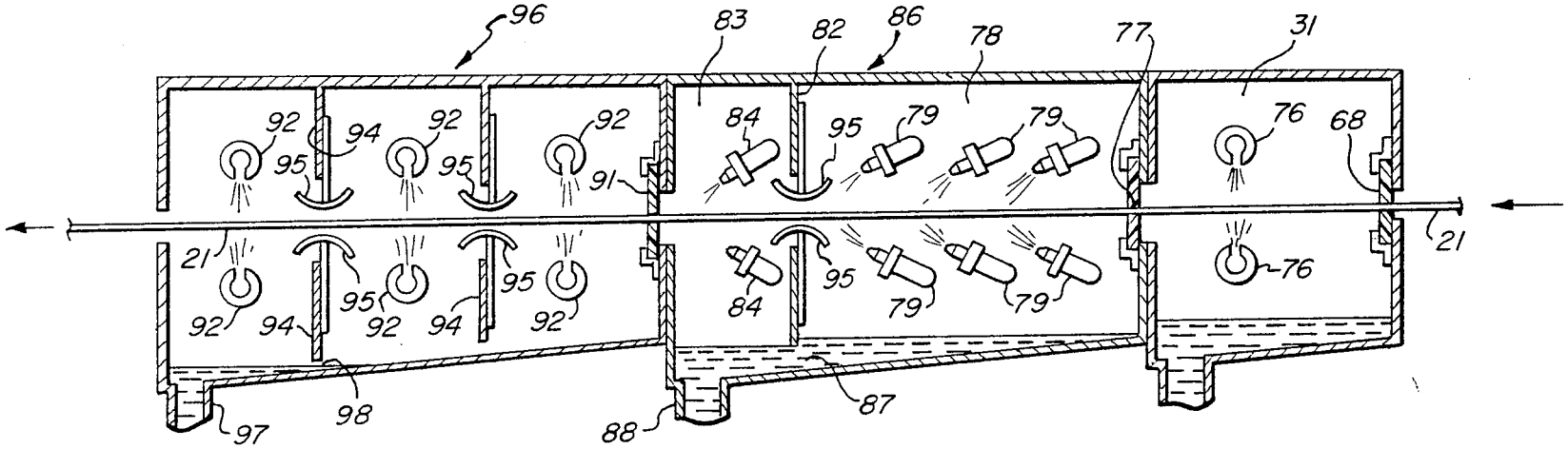
FIG. 6 is an enlarged side elevation view of the compressed air knife chambers and the rinsing chamber in the apparatus of the invention.

The successive cleaning, rinsing and drying operations performed on strip 21 as it travels through housing 22 utilize the successive treatment chambers shown in FIGS. 2, 5 and 6. Strip 21 enters the end wall of housing 22 through an entrance aperture or process line opening 36 which opens directly into an entry chamber 37 whose opposite or left wall 38, as viewed in FIGS. 2 and 4–7, is provided with a silhouette entrance portal 39 opening into the ultrasonic cleaning chamber 41, shown in enlarged detail in FIG. 7.

Ultrasonic Cleaning

Entrance portal 39 in wall 38 is preferably provided with a "silhouette" or loose-fitting seal 42 having an opening 43 closely matching the cross-section of strip 21. Alternatively, opening 43 may be larger than but generally conforming to the cross-section of the advancing strip 21, but leaving a gap, which may be one-quarter to three-eighths inch wide, for example, around the periphery of the strip's cross-section. Entrance silhouette seal 42 may be formed of heavy felted fabric or polymer sheet or foam, for example, with its opening die cut using a short segment of strip 21 as a cutting die, thereby minimizing leakage past strip 21 as it travels through the opening 43. If the opening 43 is larger, it will permit substantial and continuous outflow of cleaning bath liquid through the gap in seal 42 past the entering strip 21, producing the outflowing liquid stream 44 shown in FIG. 7. This outflowing stream 44 is collected in the bottom of entry chamber 37 and drained through a recirculating conduit 46, as shown in FIG. 5.

Process line opening or entrance aperture 36 may also be provided with a silhouette-type wiper or squeegee 47 (FIG. 5) shaped to sweep accumulated debris, particles, oil or grease from the surface of the entering strip 21 as it passes through opening 36.

Nearfield Ultrasonic Cleaning Chamber

The active portion of cleaning chamber 41 through which strip 21 travels endwise during the cleaning operation is an elongated flat passageway 48 defined by two vibrating plates, preferably horizontal and spaced apart vertically, an upper plate 49 and a lower plate 51. Plates 49 and 51 comprise independent ultrasonic diaphragms, preferably vibrated at different frequencies, creating traveling reverberatory waves of intense ultrasonic energy between themselves, coupled by the cleaning liquid to the advancing immersed strip. The highly active ultrasonic region, approximately one wavelength deep, close to each ultrasonic diaphragm is termed the "nearfield," and in the present invention, the travelling strip 21 passes through the juxtaposed nearfields of both plates 49 and 51, greatly intensifying their effectiveness.

Figure 8:
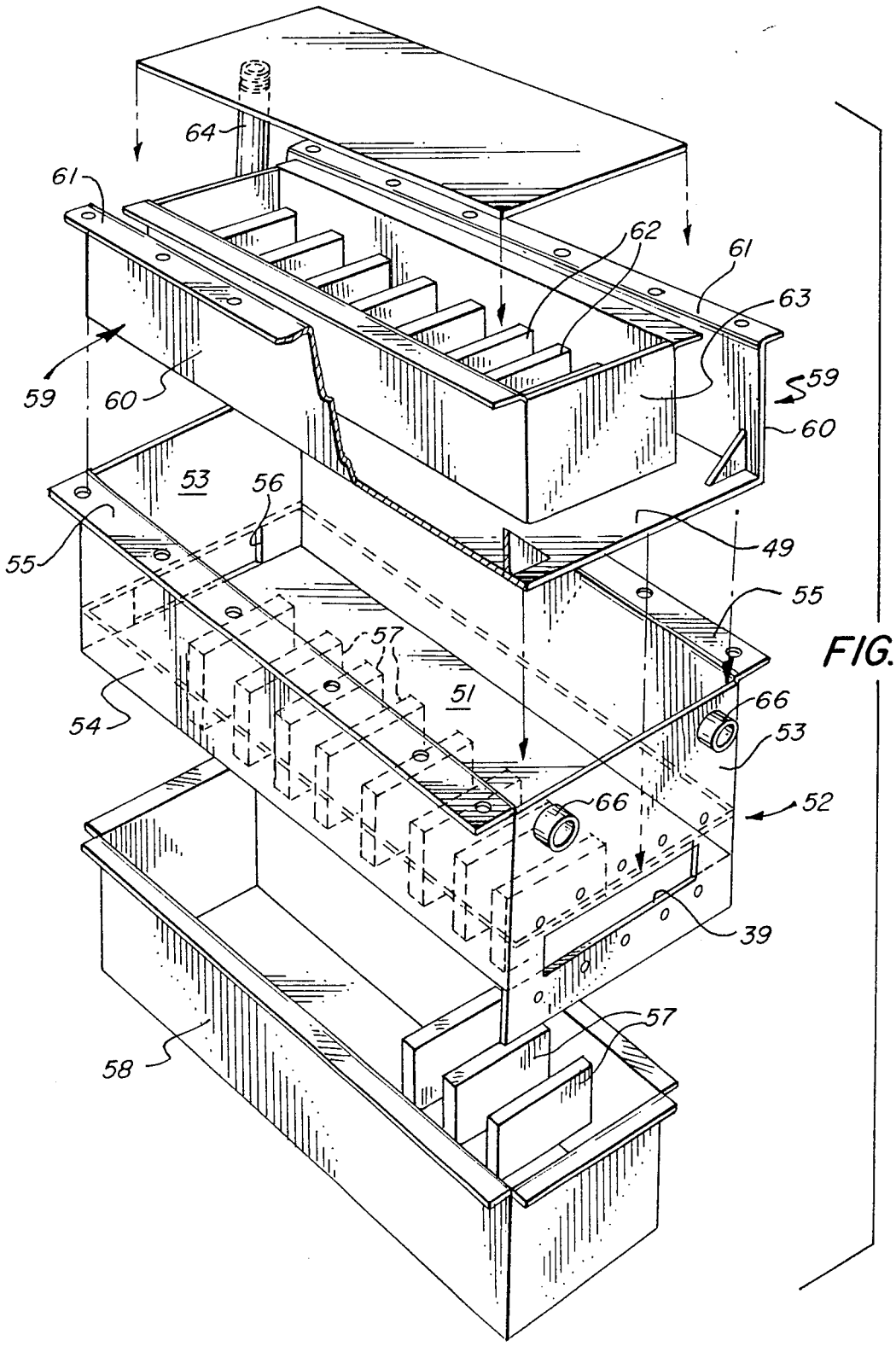
FIG. 8 is an exploded perspective view of the component subassemblies which are combined to form the cleaning liquid chamber shown in FIG. 7.

The subassemblies combined to form cleaning chamber 41 are shown in FIG. 8. A box-shaped rectangular tank 52 has rectangular end walls 53 and rectangular sidewalls 54 with outwardly extending apertured mounting flanges 55 formed along their upper edges. The bottom of tank 52 is formed by lower vibratory plate 51, with entrance portal 39 and a corresponding exit portal 56 being formed in end walls 53 just above the lower plate 51.

Figure 7:
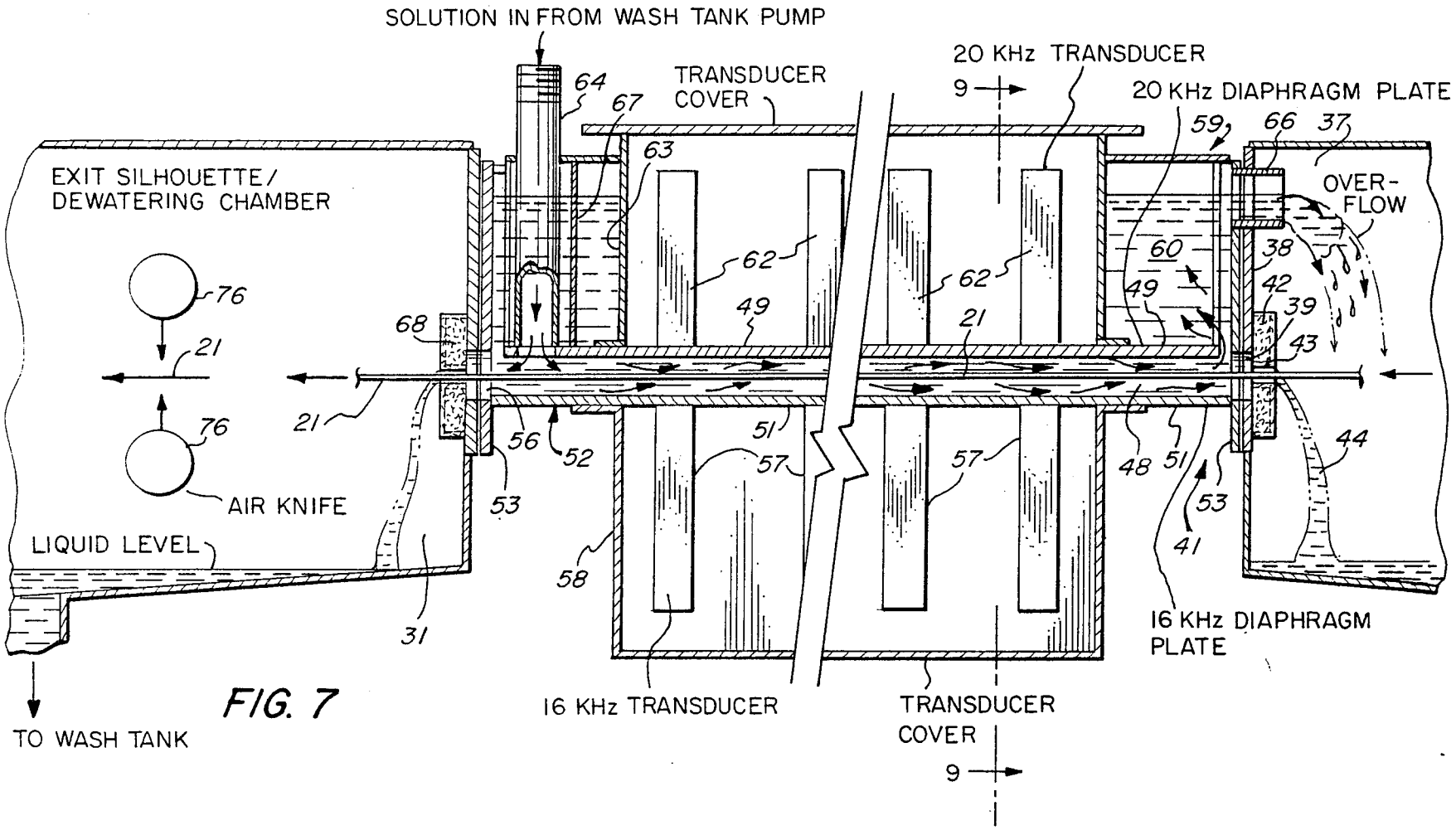
FIG. 7 is a further enlarged cross-sectional side elevation view of the ultrasonic cleaning bath chamber in the unit of FIG. 1, showing the flow path of the cleaning liquid and the configuration of the ultrasonic vibrating plates defining the liquid-filled treatment passageway.

A bank of ultrasonic transducers 57, preferably magnetostrictive type, have their upper ends brazed to the under surface of plate 51 are shown in the lower portion of FIG. 8, enclosed in a protective cover 58. Lower plate 51 thus forms the tank bottom above which the cleaning liquid in chamber 41 is contained, and strip 21 travels through passageway 48 in chamber 41, juxtaposed continuously to bottom plate 51 as shown in FIG. 7.

Suspended inside box-shaped tank 52 is a second box-like U-shaped platform comprised of upper plate 49 whose outer side edges are welded to the lower edges of sidewalls 60, whose upper edges are formed as outwardly extending apertured flanges 61 designed to rest on and be supported by flanges 55, where bolts through aligned flange apertures secure each pair of flanges 55–61 together.

Platform sidewalls 60 are spaced inward from tank sidewalls 54, and upper plate 49 is both narrower and shorter than lower plate 51 as shown in the FIGURES, leaving space for cleaning liquid circulation around the edges of upper plate 49. A second bank of ultrasonic transducers 62, preferably magnetostrictive type, have their lower ends brazed to the upper surface of upper vibratory plate 49. A protective cover 63 encloses transducers 62, the lower edge of cover 63 being welded to the upper surface of plate 49. Cleaning liquid circulates freely around the outside of cover 63, but cover 63 keeps the liquid from contacting transducers 62.

Counter-current flow of cleaning liquid through chamber 41 is maintained by a delivery conduit 64 entering the downstream end of tank 52. In the FIGURES, conduit 64 is shown entering the cleaning chamber 41 from above, and delivering recirculated liquid through an aperture formed in the corner of plate 49, directly into the downstream end of passageway 48 near exit portal 56.

Overflow weir portals 66 are formed in the opposite or upstream end wall 53 of tank 52. A baffle plate 67 spanning the U-shaped platform 59 between cover 63 and conduit 64 and welded or brazed to upper plate 49 and sidewalls 60 blocks direct flow of liquid from conduit 64 past cover 63 to overflow portals 66. Instead, liquid entering tank 52 through conduit 64 normally travels through passageway 48 in the direction opposite to that of strip 21, and circulates upward around the upstream end of plate 49 toward portals 66, as shown in FIG. 7.

As shown in the FIGURES, the cleaning liquid in tank 52 is free to circulate between sidewalls 60 of platform 59 and sidewalls 54 of tank 52, as well as around upper protective cover 63 between sidewalls 60, baffle plate 67 and entrance end wall 53 of tank 52. This assures ample depth of liquid above strip 21 travelling through passageway 48 at the bottom of chamber 41, avoiding entrained air bubbles and carrying away unwanted heat produced by the ultrasonic energy delivered to plates 49 and 51. A considerable volume of liquid from tank 52 may also escape through silhouette 42 in entrance portal 39 and through a similar silhouette 68 mounted in exit portal 56.

The outflowing streams from silhouettes 42 and 68 at both ends of passageway 48 are respectively collected in entry chamber 37 and in a first air knife dewatering chamber 31, from which they are drained into a wash solution storage tank 71. Overflow liquid from weir portals 66 is also collected in entry chamber 37. Recirculation pump 72 draws liquid from tank 71 and delivers it to chamber 41 at a rate selected to maintain the liquid level in tank 52 overflowing through overflow portals 66. Storage tank 71 may hold as much as 250 gallons of liquid, and acts as a surge tank, assuring ample volume of liquid continuously supplied to passageway 48. Tank 71 is preferably baffled to promote settling of any particulate residues cleaned from strip 21, and a cooling coil 73 may be provided in tank 71 to remove the heat added in passageway 48 by the ultrasonic energy, and thus maintain the liquid at optimum treatment temperature. Similarly, a thermostatically controlled heating coil may be immersed in the liquid in tank 71 if desired, particularly for startup temperature adjustment, and also for fine adjustment of operating temperatures whenever required. Oil separation or skimming enclosures similar to surface oil booms or fences may be employed in tank 71 to remove oil cleaned from the surface of strip 21 if desired. A filter 74 installed in the pump's recirculation conduit aids in maintaining the effectiveness of the cleaning liquid, which is customarily useful for many days, often for a week or more.

Figure 9:
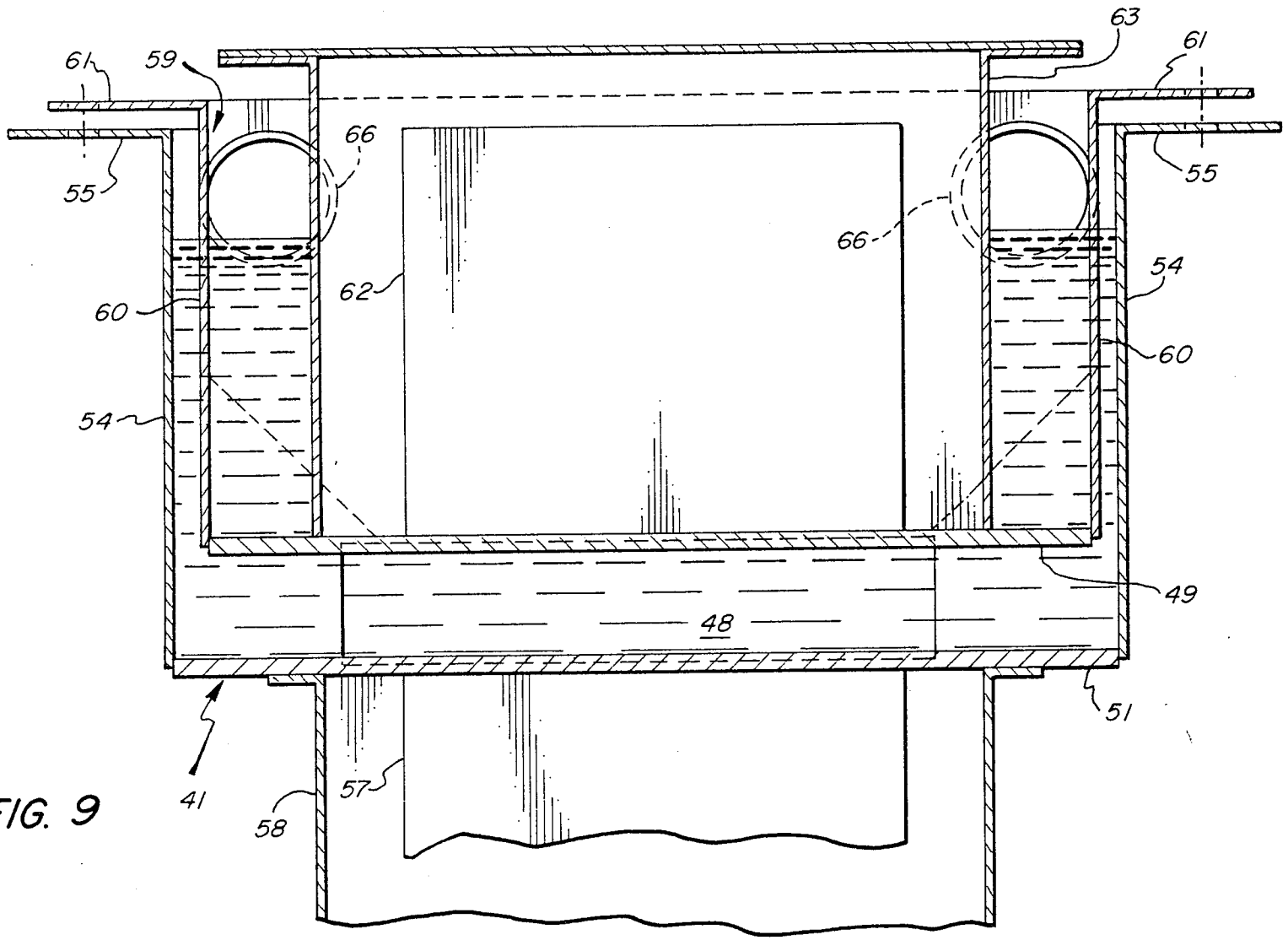
FIG. 9 is an enlarged cross-sectional end elevation view of ultrasonic cleaning chamber 41, taken along the plane 9—9 shown in FIG. 7; and, FIG. 10 is a schematic flow diagram of the cleaning liquid and rinse water circulation systems in the unit shown in the drawings.

The facing ultrasonic vibratory diaphragm plates 49 and 51 are independently suspended, as shown in FIGS. 8 and 9, rather than being formed as opposite walls of a single chute, such as Holl's rectangular tube 44, with parallel diaphragm walls 52, shown in FIG. 3 of Holl U.S. Pat. No. 4,071,225. Holl's chute is upright and preferably vertical, designed for flowing treatment of slurries and liquid-solid mixtures descending therethrough in mixing, emulsifying or deagglomerating treatments. Holl's disclosure does not suggest or foreshadow the methods and apparatus of this invention.

Dewatering, Rinsing and Drying

Strip 21 emerging from the ultrasonic cleaning operation performed in passageway 48, exits therefrom through silhouette 68 into dewatering chamber 31. Compressed air supplied by pressure blower 26 is directed at both top and bottom surfaces of advancing strip 21 through a pair of air knives 76 between which strip 21 passes, as shown in FIGS. 5, 6 and 7. Cleaning liquid remaining on strip 21 after it leaves the ultrasonic liquid bath is blasted from the surfaces of strip 21 by the air streams delivered by the air knives 76.

Dewatering chamber 31 is provided with a felt silhouette exit portal 77 through which strip 21 passes into a first spray rinse chamber 78, where a plurality of pairs of rinse water nozzles 79 spray both upper and lower surfaces of strip 21 as it passes between the successive nozzle pairs 79, dissolving and removing any remaining traces of cleaning liquid carried by strip 21.

Strip 21 then passes through an aligned aperture formed in a partition wall 82 into a second spray rinse chamber 83, where a final pair of clean rinse water nozzles 84 provide the final rinse for strip 21. Chambers 78 and 83 are preferably formed as adjacent portions of the same rinse housing 86, subdivided by partition 82, which spans housing 86 but terminates above the bottom of housing 86, leaving a scupper 87 draining all used rinse water into a drain conduit 88 leading to a rinse water tank 89.

Rinse water recirculation pump 90 has its intake connected to rinse water tank 89, and its outlet is connected to deliver recycled wash water via suitable filters 106 to rinse water nozzles 79.

Fresh tap water under water main pressure is delivered to the final clean water rinse spray nozzle pair 84. If desired, this incoming tap water can be directed through cooling coils or heat exchangers to cool the generator cabinet enclosing the transformer and generator circuitry supplying high frequency ultrasonic energization for transducers 57 and 62. The same tap water can be directed through cooling coils immersed in the cleaning liquid storage tank 71 and the rinse water tank 89 if desired, before it is delivered to the final nozzle pair 84.

As shown in FIGS. 5 and 6, the strip 21 leaving rinse housing 86 passes if desired through a silhouette wiper or squeegee 91, emerging into one or more pairs of dewatering air knives 92. In the Figures, three pairs of air knives 92 are mounted in three individual dewatering chambers 93 separated by partitions 94 inside a single dewatering housing 96. Rinse water blasted from strip 21 by the pairs of air knives 92 collects in the bottom of housing 96, from which it enters a drain conduit 97. Compressed air, heated by its pressurization in pressure blower 26, promotes evaporation of moisture remaining on strip 21.

Aperture partitions 94 have their central apertures aligned along the path of advance of strip 21, and like partition 82 in spray rinse housing 86, they span the major part of the cross-section of dewatering housing 96, but they terminate above the bottom of housing 96, leaving scuppers 98 through which water passes to drain 97.

The bottoms of housings 86 and 96 as well as the bottoms of dewatering chamber 31 and entry chamber 37 all preferably slope toward their respective drain conduits to promote effective drainage and recirculation.

As indicated in FIG. 6, the apertures of partitions 82 and 94 are preferably provided with curved feed guides 95 converging from the chamber into each respective aperture, serving to guide the end of each new strip as it is fed into the chambers in succession. The feed guides may be formed in adjustable pairs, movable apart or toward each other to minimize escape of rinsing sprays or compressed air through the partition apertures.

Housing 22 of the cleaning unit 23 is preferably provided with hinged access doors 116, 117, 118 and 119, opening outward to provide access to the chambers aligned along the travel path of strip 21. These doors are removed for clarity in the schematic side view of FIG. 2, showing the successive treatment chambers exposed to view. In addition, the proximal side of chambers 31, 32, 37, 78, 83 and 96 are also preferably formed as hinged doors or removable panels for convenient adjustment, maintenance and manual feeding of a new strip 21 whenever required.

Infrared dryer 24 shown in FIG. 1 provides a drying tunnel chamber entered by strip 21 as it leaves the apertured end wall of the final dewatering air knife chamber in housing 96, and the advancing strip 21 moves between banks of infrared heaters in dryer 24, from which it emerges warm and dry, as shown at the left side of FIG. 1.

Figure 10:
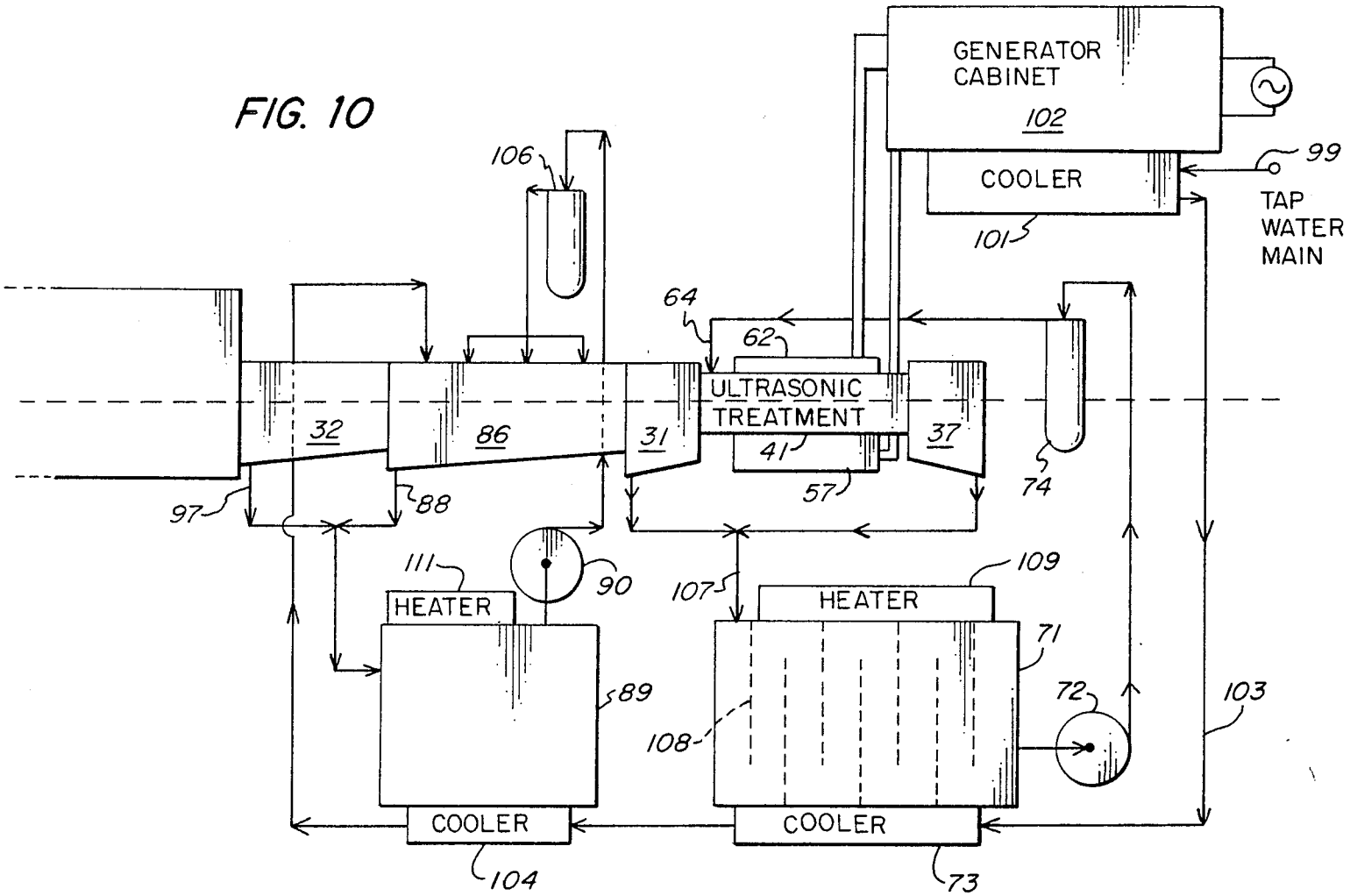

As shown in the flowchart of FIG. 10, the tap water entering the system from the water main 99 may be directed through a generator cabinet cooler 101 absorbing heat produced in the ultrasonic generator cabinet 102. From cooler 101, the fresh water may be carried via conduit 103 to cooler 73 installed in the cleaning liquid storage tank 71, then to a similar cooler 104 on recycled rinse water storage tank 89, and finally to the exit end of spray rinse chamber 78 where it is delivered to clean rinse water nozzles 84 in chamber 83.

The drain conduits 88 and 97 from housing 86 and 96 both deliver recovered rinse water to rinse water storage tank 89, from which recirculation pump 90 delivers the recycled rinse water via filter 106 to nozzle pairs 79 in chamber 78 of housing 86.

The circulation flow path of cleaning liquid from the drain conduits 107 of chambers 31 and 37 is also shown in FIG. 10, entering storage tank 71, preferably equipped with baffle plates 108 promoting sedimentation and settling of particulate solids, and thorough temperature regulation by cooler 73 or heater 109 as required. Pump 72 draws cleaning liquid from tank 71 and delivers it via filter 74 to the delivery conduit 64 at the exit end of passageway 48 in ultrasonic treatment chamber 41. Heat from transducer banks 57 and 62 in chamber 41 is absorbed by the liquid counterflowing therethrough, and removed by cooler 73 as the recycled liquid travels back through storage tank 71 during its next cycle.

Heater 111 installed in rinse water tank 89 may be employed, alternately with cooler 104, to adjust the temperature of the rinse water in tank 89 to the value desired for delivery by pump 90 via filter 106 to nozzle pairs 79.

The relatively rigid strip 21 need not be bent or flexed during its travel through the unit 20. Tractive pinch rolls 112 positioned to push or pull strip 21, or both, are shown in FIG. 1, and guides 95 adjustably mounted on partition walls 82 and 94 assure the smooth feeding travel of the entering end of each fresh strip 21.

By employing respective different ultrasonic frequencies, typically 20 KHz and 16 KHz for the upper and lower transducer banks 62 and 57, an interfering beat frequency of 4,000 cycles produces non-standing waves moving rapidly along passageway 48, enhancing the nearfield vibratory effects at the plate-liquid interface. The distance between the vibrating diaphragm plates 49 and 51 is not a critical dimension. It is not "distance tuned" for resonance, as in U.S. Pat. Nos. 4,556,467 and 3,572,352. Instead, plate dimensions are selected for "face resonance" tuning, and with two plates facing each other, maximum energy is produced at the plate-liquid interface, with the nearfield effects of both plates cooperating to produce highly effective cleaning action. If identical frequencies are employed to energize both plates 49 and 51, phase-shifting may be used to avoid cancellation effects in the vicinity of strip 21.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Ultrasonic apparatus for cleaning elongated unflexed straight strip material advancing along a straight travel path through the apparatus, comprising, a cleaning liquid chamber having substantial depth beneath a free liquid surface of a cleaning liquid and bounded by a lower vibratory diaphragm plate, having a first plurality of ultrasonic transducers anchored to its under surface energized at a first ultrasonic frequency, and having elongated side edges and end edges respectively joined to elongated side walls, extending upwardly above the free liquid surface, and to upwardly extending end walls secured to said side walls to form a cleaning liquid tank enclosing said cleaning liquid chamber, said side walls having upper edges incorporating supporting means, positioned above said free liquid surface, said first plurality of ultrasonic transducers being vibrationally coupled to said liquid through said lower vibratory plate with means physically isolating said first plurality of transducers from said liquid, a separate, upper vibratory diaphragm plate independently suspended in said tank beneath said free liquid surface adjacent to and upwardly spaced from said lower diaphragm plate, for free vibratory movement independent of said lower vibratory diaphragm plate, and having a second plurality of ultrasonic transducers anchored to its upper surface and being vibrationally coupled through said upper vibratory plate to said liquid with means physically isolating said second plurality of ultrasonic transducers from said liquid, thus forming between the facing surfaces of said independent vibratory plates an elongated ultrasonic treatment passageway immersed beneath said free liquid surface and encompassing the straight travel path of said elongated strip, with the end walls of said tank being provided with aperture means forming respective entry and exit portals for the passage of said straight strip therethrough, each provided with a silhouette panel spanning the portal and having an opening therethrough positioned on said travel path with an outline substantially matching the cross-section of said elongated strip but having dimensions exceeding the dimensions of said strip, means forming an entry chamber adjacent to the entry portal and equipped with a drain, means forming a dewatering chamber adjacent to the exit portal and equipped with a drain, a recirculating pump having an intake and an outlet, return conduit means joining both said drains to the intake of said pump, and delivery conduit means connecting the outlet of said pump to said passageway adjacent to said exit portal, whereby strip material advancing along the travel path enters said entry portal silhouette opening, travels along said ultrasonic treatment passageway between said vibratory diaphragm plates and exits through said exit portal silhouette opening, while cleaning liquid from said recirculating pump counterflows along the passageway between said diaphragm plates in the direction opposite to the direction of advance of the strip, and flows out of said tank past said entering strip through said entry portal silhouette opening.

2. The apparatus defined in claim 1, wherein the return conduit means includes a storage tank having storage volume substantially larger than the volume of the cleaning liquid tank.

3. The apparatus defined in claim 2 wherein said cleaning liquid storage tank is provided with internal baffle partitions promoting separation and settling of particulate solids from said cleaning liquid.

4. The apparatus defined in claim 2, wherein said cleaning liquid storage tank is provided with cooling means.

5. The apparatus defined in claim 2, wherein said cleaning liquid storage tank is provided with heating means.

6. The apparatus defined in claim 1, wherein the cleaning liquid tank is provided with overflow portal means in its entry end wall positioned at a height substantially above the level of said upper vibratory diaphragm plate and delivering overflow liquid into said entry chamber, and wherein the recirculating pump maintains the level of cleaning liquid in the cleaning liquid tank at the overflow level of said overflow portal means, maintaining immersion of said treatment passageway substantially below the free surface of cleaning liquid counterflowing through said tank.

7. The apparatus defined in claim 1, wherein said means physically isolating said first and second plurality of ultrasonic transducers include protective cover means enclosing each plurality of transducers mounted on the diaphragm plate surface on which the transducers are mounted.

8. The apparatus defined in claim 1, wherein the separate pluralities of transducers are energized at substantially different ultrasonic frequencies.

9. The apparatus defined in claim 8, wherein the transducers anchored to one vibratory plate are energized at a frequency which is approximately 80% of the frequency at which the transducers anchored to the other vibratory plate are energized, whereby interference waves of ultrasonic energy travel rapidly along said ultrasonic treatment passageway.

10. The apparatus defined in claim 9, wherein the transducers anchored to one vibratory plate are energized at approximately 20 KHz while the transducers anchored to the other plate are energized at approximately 16 KHz, thereby creating 4 KHz travelling vibratory interference waves.

11. The apparatus defined in claim 1 further including baffle means spanning said tank above said passageway and adjacent to said exit portal between the pump's delivery conduit and the entry portal, positioned to block flow of cleaning liquid from the delivery conduit direct to the entry portal and diverting delivered cleaning liquid for counterflow through said treatment passageway toward said entry portal.

12. The apparatus defined in claim 1, including filter means interposed in the delivery conduit means joining said pump to said passageway.

13. The apparatus defined in claim 1, further including compressed air delivery air knife means incorporating a pair of slots facing and closely flanking the straight travel path of the strip in the dewatering chamber, whereby cleaning liquid remaining on the strip emerging from the exit portal silhouette opening is blasted off the strip's surface by compressed air streams from said slots.

14. The apparatus defined in claim 1, further including a spray rinse chamber enclosing the travel path beyond the exit portal and incorporating at least one pair of first rinse nozzles flanking the path and delivering rinse water impinging on the advancing strip.

15. The apparatus defined in claim 14, further including a rinse drain conduit collecting rinse water after use, a rinse water recycling pump with an intake connected to the drain conduit and an outlet connected to deliver recycled rinse water to the first rinse nozzles.

16. The apparatus defined in claim 15, further including at least one additional pair of rinse nozzles flanking the trael path of the advancing strip after it has passed between said first rinse nozzles, with said additional rinse nozzles being supplied by a source of fresh, nonrecycled rinse water.

17. The apparatus defined in claim 14, including a plurality of pairs of said first rinse nozzles.

18. The apparatus defined in claim 14, further including a dewatering chamber enclosing the advancing strip's travel path following its passage between said rinse nozzles, with compressed air delivery air knife means incorporating at least one pair of slots facing and closely flanking the travel path of the strip.

19. The apparatus defined in claim 18, wherein the air knife means includes a plurality of pairs of said slots.

20. The apparatus defined in claim 18, further including a heated drying chamber enclosing the strip's travel path after it has passed through said dewatering chamber, wherein moisture remainin9 on the strip is removed.

* * * * *